US006967620B2

(12) United States Patent
Ryken, Jr. et al.

(10) Patent No.: US 6,967,620 B2
(45) Date of Patent: Nov. 22, 2005

(54) MICROSTRIP ANTENNA HAVING MODE SUPPRESSION SLOTS

(75) Inventors: Marvin L. Ryken, Jr., Oxnard, CA (US); Albert Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 124 days.

(21) Appl. No.: 10/761,915

(22) Filed: Jan. 15, 2004

(65) Prior Publication Data

US 2005/0156784 A1 Jul. 21, 2005

(51) Int. Cl.[7] ..... H01Q 1/38

(52) U.S. Cl. ..... 343/700 MS

(58) Field of Search ..... 343/700 MS, 767, 343/770

(56) References Cited

U.S. PATENT DOCUMENTS

| | | | | |
|---|---|---|---|---|
| 3,947,850 | A * | 3/1976 | Kaloi | 343/795 |
| 4,130,822 | A * | 12/1978 | Conroy | 343/700 MS |
| 6,121,930 | A * | 9/2000 | Grangeat et al. | 343/700 MS |
| 6,133,879 | A * | 10/2000 | Grangeat et al. | 343/700 MS |
| 6,342,864 | B1 * | 1/2002 | Muramoto et al. | 343/770 |
| 6,587,076 | B2 * | 7/2003 | Fujii et al. | 342/372 |
| 2002/0089452 | A1 * | 7/2002 | Lovestead | 343/700 MS |
| 2003/0122718 | A1 * | 7/2003 | Fang et al. | 343/702 |

* cited by examiner

*Primary Examiner*—Don Wong
*Assistant Examiner*—Hung Tran Vy
(74) *Attorney, Agent, or Firm*—David S. Kalmbaugh

(57) ABSTRACT

A TM microstrip antenna which having a pair of mode suppression slots for transmitting telemetry data to an external source, which is adapted for use in a small area on a weapons system such as a missile. The mode suppression slots reduce noise from the TM microstrip antenna at the GPS L-1 band providing increased isolation between the TM microstrip antenna and a GPS receiving antenna mounted in proximity to the TM microstrip antenna.

20 Claims, 4 Drawing Sheets

MICROSTRIP ANTENNA HAVING MODE SUPPRESSION SLOTS

BACKGROUND OF THE INVENTION

1. Field of the Invention

The present invention relates generally to a microstrip antenna for use on a weapons system to transmit telemetry data from the weapons system. More specifically, the present invention relates to a microstrip antenna which has mode suppression slots and which is adapted for use on a weapons system such as a missile.

2. Description of the Prior Art

There is currently a need for a microstrip antenna for use in a small diameter projectile and for transmitting telemetry data while suppressing unwanted modes of operation. Normally, microstrip antennas exhibit many modes of operation, that is microstrip antennas will work at multiple frequencies depending upon their construction. A problem occurs when the microstrip antenna is designed to radiate at one mode of operation and not at a frequency band that is outside of the desired mode of operation.

For the desired mode of operation which is 2.250 GHz, the noise radiated by a TM microstrip antenna at the GPS L-1 band (1.575 GHZ) is high enough to raise the effective noise floor to a GPS receiver to substantially reduce the effectiveness of the GPS receiver.

Thus, there is need to suppress the unwanted noise radiated by the TM microstrip antenna to allow the GPS receiver and its associated antenna to operate effectively at the GPS L-1 band.

SUMMARY OF THE INVENTION

The present invention overcomes some of the difficulties of the past in that comprises a highly effective TM microstrip antenna for suppressing unwanted modes of operation which occur in the GPS L-1 band of 1.575 GHz ±10 MHz and substantially reduce noise radiated by the TM microstrip antenna at GPS L-1 band.

The TM microstrip antenna comprising the present invention includes a copper patch, and a dielectric substrate upon which the copper patch is mounted. The TM microstrip antenna also has a pair of elongated slots which are orientated in the direction of surface current flow on the copper patch for the antenna so as not alter the operation of TM microstrip antenna when the antenna is transmitting telemetry data at the TM band. When the antenna is operating GPS L-1 Band the slots reduce current density thereby substantially eliminating noise from a received signal at the GPS L-1 Band and providing increased isolation from a closely mounted GPS receiving antenna. This allows a GPS microstrip antenna in proximity to the TM microstrip antenna to operate at the GPS L-1 Band since there is adequate isolation between the between the TM microstrip antenna and the GPS receiving antenna.

DETAILED DESCRIPTION OF A PREFERRED EMBODIMENT OF THE INVENTION

Figure 1:
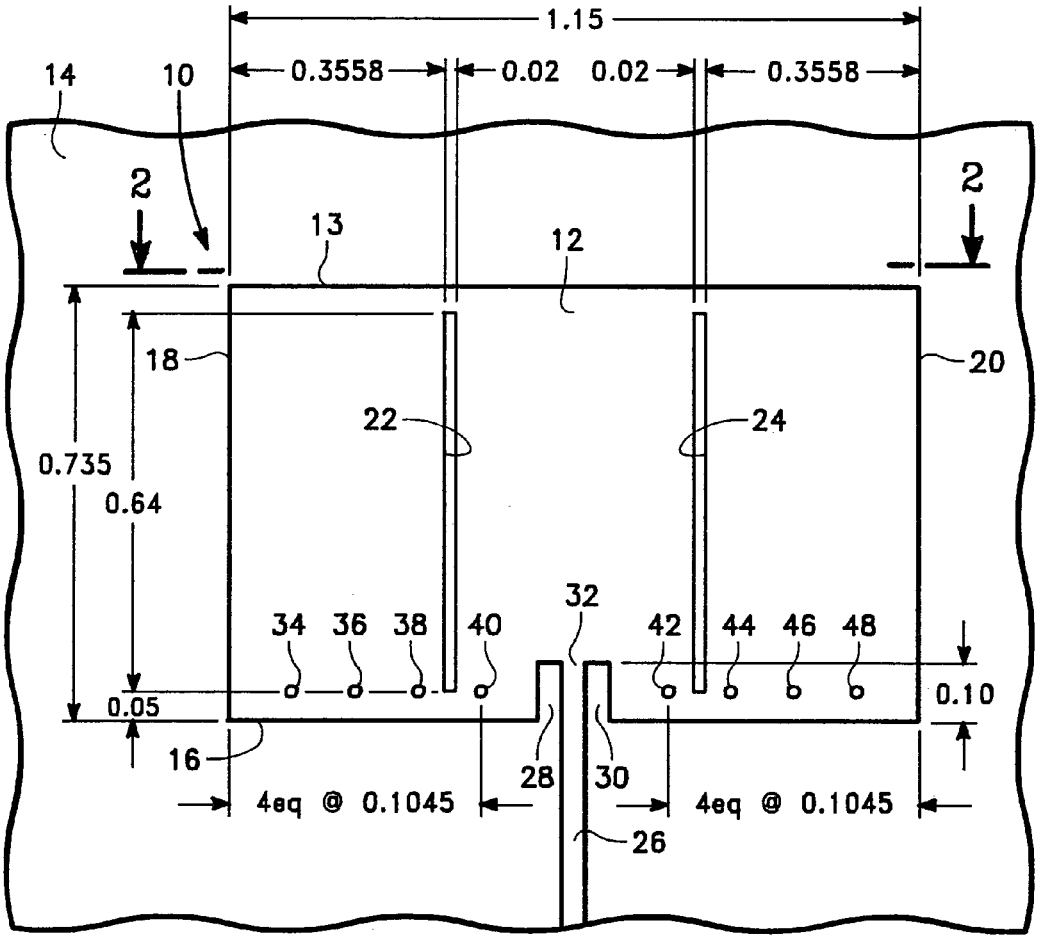
FIG. 1 is a plan view of a preferred embodiment of the present invention which comprises a TM microstrip antenna for use on a weapons system to transmit telemetry data to a receiving station.
Figure 2:
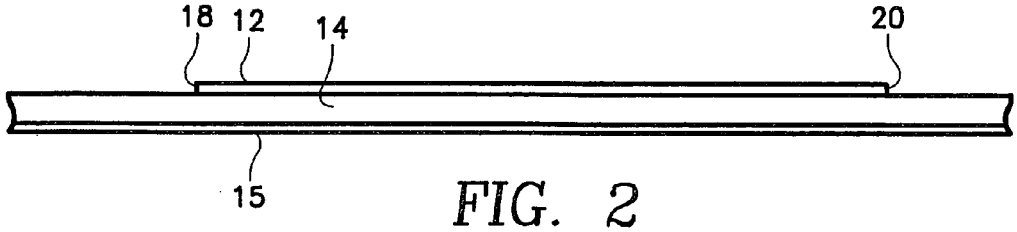
FIG. 2 is a side view of the microstrip antenna of FIG. 1.

Referring first to FIGS. 1 and 2, there is shown a TM microstrip antenna 10 for transmitting telemetry data via an RF carrier signal to a receiving station. TM microstrip antenna operates in the telemetry band (TM band) at a center frequency of 2.25 GHz. TM microstrip antenna 10 has linear polarization which is achieved by the copper patch/antenna element 12 depicted in FIG. 1. The bandwidth for TM microstrip antenna 10 is ±10 MHz.

Microstrip antenna 10 includes copper patch/antenna element 12, a dielectric substrate 14 which has the antenna element 12 mounted on its upper surface and a ground plane 15 which is positioned below the dielectric substrate 14 as shown in FIG. 2. The dielectric substrate 14 used in the preferred embodiment of the present invention has a thickness of 0.050 inches and is fabricated from a laminate material RT/Duroid 6002 which is commercially available from Rogers Corporation of Rogers, Conn. The dielectric material selected for the microstrip antenna 10 provides sufficient strength and physical and electrical stability to satisfy environmental requirements and is also to mount on or within a missile.

Microstrip antenna's 10 linear polarization is achieved by the rectangular shaped copper patch 12, which has sides/edges 13, 16, 18 and 20 of equal length. The length of each edge 13, and 16 of antenna element 12 is 1.15 inches, and the length of each edge 18 and 20 of antenna element 12 is 0.735 inches resulting in rectangular shaped antenna element. Dielectric substrate 14 is sized the same as antenna element 12 and also rectangular in shape.

At this time, it should be noted that the dielectric substrate 14 and ground plane 15 extend beyond the antenna element 12 as shown in FIGS. 1 and 2.

Antenna 10 also has two mode suppression slots 22 and 24 which are parallel respectively to edges 18 and 20 of antenna 10. Slot 22 is positioned approximately 0.3558 inches from edge 18 of antenna, while slot 24 is positioned approximately 0.3558 inches from edge 18 of antenna 10. Each slot 22 and 24 has an overall length 0.64 inches and a width 0.020 inches. One end of each slot 22 and 24 is located approximately 0.05 inches from edge 16 of antenna 10. The mode suppression slots 22 and 24 are orientated in the direction of surface current flow on the copper patch 12 for antenna 10 so as not alter the operation of antenna 10 when antenna 10 is transmitting telemetry data at the TM band.

Other modes of operation have currents that cross the mode suppression slots 22 and 24 are impacted by the slots. The slots 22 and 24 result in the frequency of the mode changing so that the frequency moves away from the desired mode's frequency which results in a reduction in interference.

The signal input to antenna 10 is a copper transmission line 26 which has a characteristic impedance of 100 ohms. The copper patch 12 includes a pair of notches 28 and 30 which are positioned on each side of transmission line 28 in proximity to the element feed point 32 for copper patch 12. Notches 28 and 30 are impedance matching notches for the antenna element 12 of TM microstrip antenna 10.

TM microstrip antenna 10 has also eight vias 34, 36, 38, 40, 42, 44, 46 and 48, which are plated through copper holes connecting the antenna element 12 to the ground plane 15. Vias 34, 36, 38, 40, 42, 44, 46 and 48 are positioned approximately 0.05 inches from the edge 16 of antenna 10. The vias 42, 44, 46, and 48 are spaced apart from one another 0.1045 inches with via 48 being positioned 0.1045 inches from edge 20, via 46 being positioned 0.2090 inches from edge 20, via 44 being positioned 0.3135 inches from edge 20, and via 42 being positioned 0.4180 inches from edge 20. The vias 34, 36, 38, and 40 are also spaced apart from one another 0.1045 inches with via 34 being positioned 0.1045 inches from edge 18, via 36 being positioned 0.2090 inches from edge 18, via 38 being positioned 0.3135 inches from edge 18, and via 40 being positioned 0.4180 inches from edge 18.

The vias 34, 36, 38, 40, 42, 44, 46 and 48 short copper patch 12 to the ground plane allowing TM microstrip antenna 10 to operate as a grounded ¼ wavelength radiating antenna.

Figure 3:
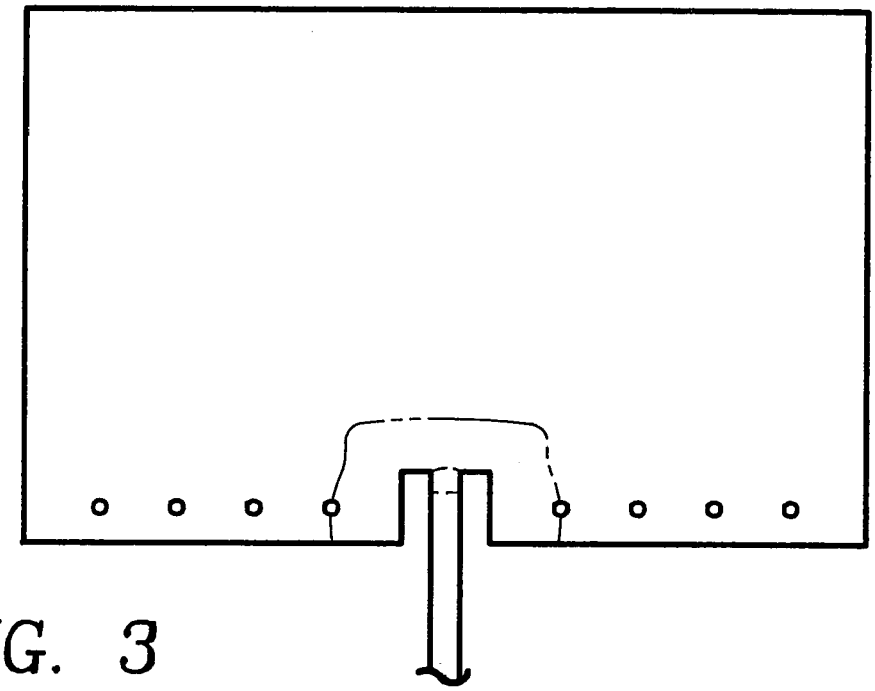
FIGS. 3 and 4 depict current density on a TM microstrip antenna without slots at various operating frequencies.
Figure 4:
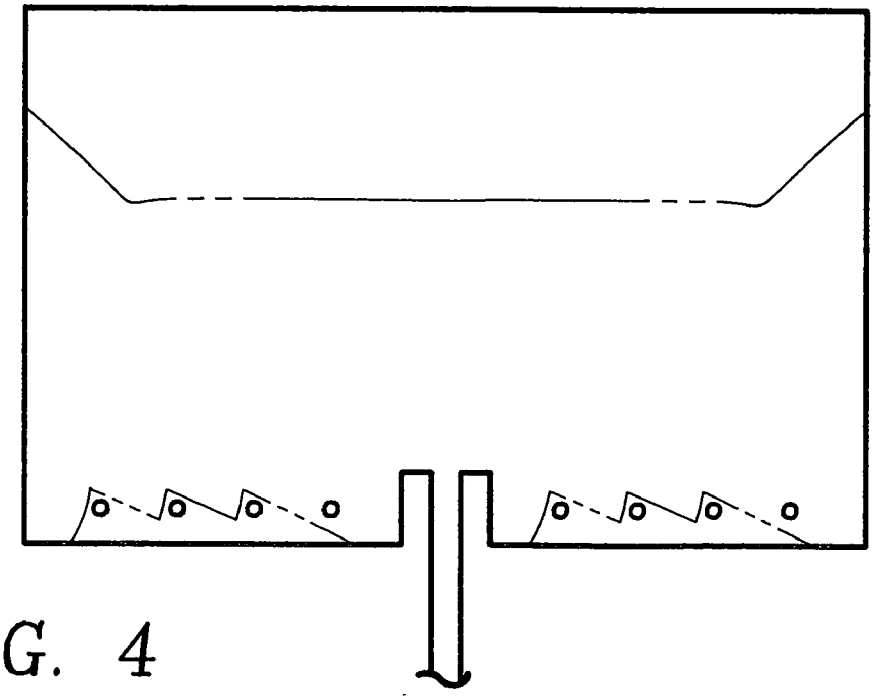

Referring to FIGS. 3 and 4, FIG. 3 depicts current density on a TM microstrip antenna without slots at a frequency of 1.575 GHZ which is the GPS L-1 band and FIG. 4 depicts current density on a TM microstrip antenna without slots at a frequency of 2.25 GHZ which is TM band.

Figure 5:
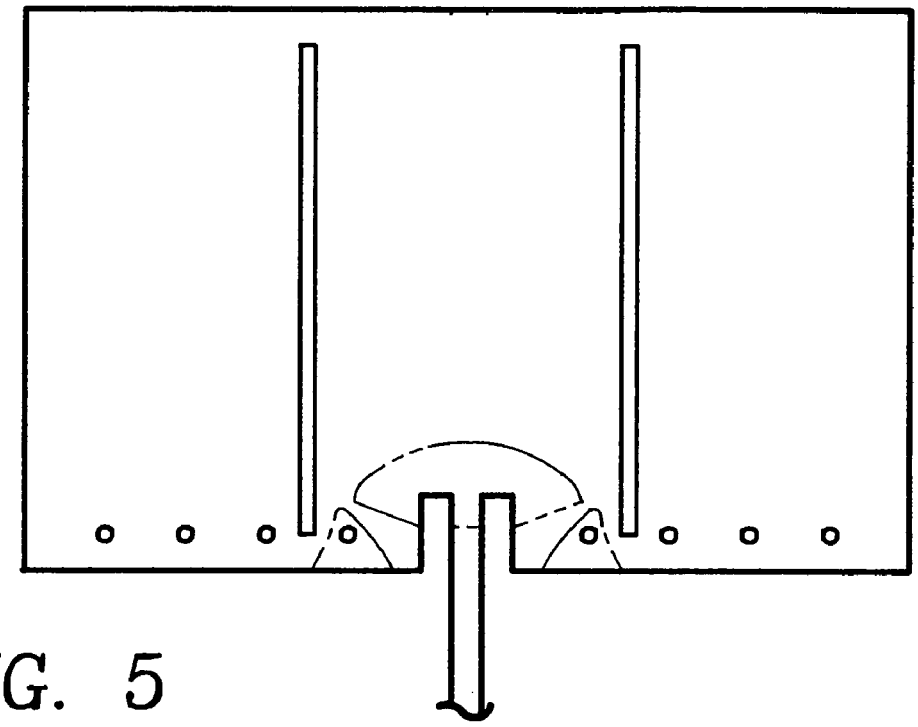
FIGS. 5 and 6 depict current density on a TM microstrip antenna with slots at various operating frequencies.
Figure 6:
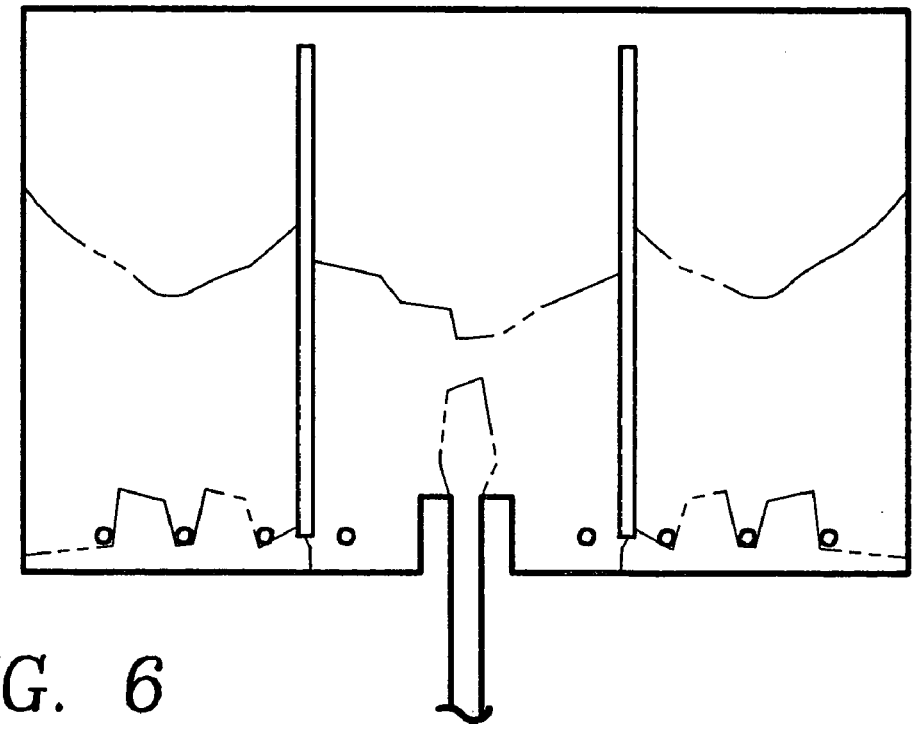

Referring to FIGS. 5 and 6 FIG. 3 depicts current density on a TM microstrip antenna with slots at a frequency of 1.575 GHZ which is the GPS L-1 band and FIG. 6 depicts current density on a TM microstrip antenna with slots at a frequency of 2.25 GHZ which is TM band.

Surface currents are similar in FIGS. 4 and 6 so that the desired mode of operation at 2.25 GHz is not altered and the antenna will produce the same radiation pattern. FIGS. 3 and 5 depict the greatest difference in current densities such that a signal received at 1.575 GHZ will be significantly impacted by the current density produced by antenna 10. As shown in FIG. 6 current density is reduced by the presence of the slots thereby eliminating noise from a received signal at the GPS L-1 Band.

Figure 7:
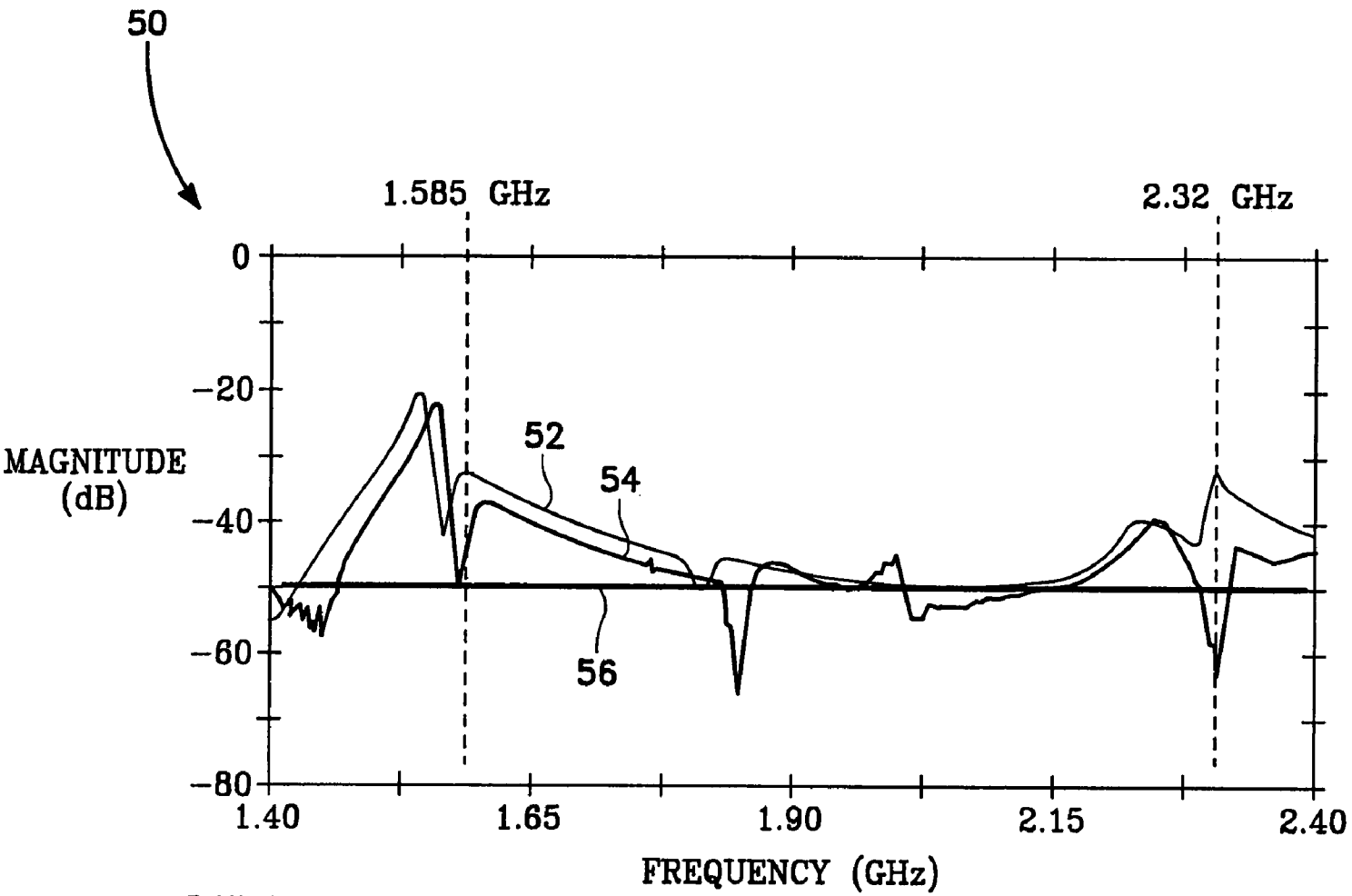
FIG. 7 depicts isolation between a telemetry antenna and a GPS receiving antenna

Referring to FIG. 7, the plots of FIG. 7, designated generally by the reference numeral 50, depict a calculated increase in isolation between the TM microstrip antenna comprising the present invention and GPS receiving antenna located adjacent the TM microstrip antenna. Plot 52 is a computer simulated isolation between the TM microstrip antenna 10 and a GPS receiving antenna while plot 54 is a measured 5 isolation between the TM microstrip antenna 10 and a GPS receiving antenna. Plot 56 is the required isolation between the TM microstrip antenna and the GPS receiving antenna. It should be noted that the plot 54 shows that the required isolation of approximately 50 decibels is achieved at 1.575 GHz and 2.25 GHz.

From the foregoing, it is readily apparent that the present invention comprises a new, unique and exceedingly useful TM microstrip antenna with a slot for transmitting telemetry data which constitutes a considerable improvement over the known prior art. Many modifications and variations of the invention are possible in light of the above teachings. It is therefore to be understood that within the scope of the appended claims that the invention may be practiced otherwise than as specifically described.

What is claimed is:

1. A microstrip antenna for use on a projectile comprising:

a dielectric substrate positioned on said projectile;

a generally rectangular shaped antenna element mounted on said dielectric substrate, said antenna element transmitting an S-Band radio frequency signal;

a pair of elongated mode suppression slots located within said antenna element, said pair of mode suppression slots being positioned parallel to one another within said antenna element, said pair of mode suppression slots being orientated in a direction for surface current flow on said antenna element to provide for substantial isolation for said antenna element from an L-Band radio frequency signal whenever said microstrip antenna receives said L-1 Band radio frequency signal from an external source; and a plurality of equally spaced apart vias said plurality of vias being aligned adjacent one elongated edge of said antenna element, said plurality of vias allowing said antenna element to operate as a grounded ¼ wavelength radiating antenna by shorting said antenna element to a ground plane positioned below said dielectric substrate.

2. The microstrip antenna of claim 1 wherein said antenna element comprises a rectangular shaped copper antenna element.

3. The microstrip antenna of claim 1 wherein each of said pair of elongated slots has an overall length 0.64 inches and a width 0.020 inches.

4. The microstrip antenna of claim 1 wherein a first elongated slot of said pair of elongated slots is positioned approximately 0.3558 inches from one end of said antenna element, and a second elongated slot of said pair of elongated slots is positioned approximately 0.3558 inches from the opposite end of said antenna element.

5. The microstrip antenna of claim 1 wherein plurality of vias comprises eight vias which are spaced apart approximately 0.1045 inches.

6. The microstrip antenna of claim 5 wherein each of said eight vias is located approximately 0.5 inches from said one elongated edge of said antenna element.

7. The microstrip antenna of claim 1 wherein each of aid eight vias comprises a copper plated through via which electrically shorts said antenna elements to said ground plane.

8. The microstrip antenna of claim 1 further comprising a copper transmission line connected to said antenna element, said copper transmission line being a signal input for said antenna element, said copper transmission line having a characteristic impedance of 100 ohms.

9. The microstrip antenna of claim 1 wherein said pair of elongated slots provide for an isolation of approximately 50 decibels at a first center frequency of 1.575 GHz and a second center frequency of 2.25 GHz.

10. The microstrip antenna of claim 1 wherein said antenna element has a length of 1.15 inches and a width of 0.735 inches.

11. A microstrip antenna for use on a projectile comprising:

a dielectric substrate positioned on said projectile;

a generally rectangular shaped antenna element mounted on said dielectric substrate, said antenna element transmitting an S-Band radio frequency signal;

a pair of elongated mode suppression slots located within said antenna element, said pair of mode suppression slots being positioned parallel to one another within said antenna element, said pair of mode suppression slots being orientated in a direction for surface current flow on said antenna element to provide for substantial isolation for said antenna element from an L-Band radio frequency signal whenever said microstrip antenna receives said L-1 Band radio frequency signal from an external source;

eight equally spaced apart vias, said eight vias being aligned adjacent one elongated edge of said antenna element, said eight vias allowing said antenna element to operate as a grounded ¼ wavelength radiating antenna by shorting said antenna element to a ground plane positioned below said dielectric substrate, each of said eight vias consisting of a copper plated through hole which electrically shorts said antenna element to said ground plane;

a copper transmission line connected to said antenna element, said copper transmission line being a signal input for said antenna element, said copper transmission line having a characteristic impedance of 100 ohms; and said pair of elongated slots providing for an isolation of approximately 50 decibels at a first center frequency of 1.575 GHz and a second center frequency of 2.25 GHz.

12. The microstrip antenna of claim 11 wherein said antenna element comprises a rectangular shaped copper antenna element.

13. The microstrip antenna of claim 11 wherein each of said pair of elongated slots has an overall length 0.64 inches and a width 0.020 inches.

14. The microstrip antenna of claim 11 wherein a first elongated slot of said pair of elongated slots is positioned approximately 0.3558 inches from one end of said antenna element, and a second elongated slot of said pair of elongated slots is positioned approximately 0.3558 inches from the opposite end of said antenna element.

15. The microstrip antenna of claim 11 wherein said eight vias are spaced apart approximately 0.1045 inches.

16. The microstrip antenna of claim 15 wherein each of said eight vias is located approximately 0.5 inches from said one elongated edge of said antenna element.

17. The microstrip antenna of claim 11 wherein said antenna element has a length of 1.15 inches and a width of 0.735 inches.

18. A microstrip antenna for use on a projectile comprising:

a dielectric substrate positioned on said projectile;

a generally rectangular shaped copper antenna element mounted on said dielectric substrate, said antenna element transmitting an S-Band radio frequency signal;

a pair of elongated mode suppression slots located within said antenna element, said pair of mode suppression slots being positioned parallel to one another within said antenna element, said pair of mode suppression slots being orientated in a direction for surface current flow on said antenna element to provide for substantial isolation for said antenna element from an L-Band radio frequency signal whenever said microstrip antenna receives said L-1 Band radio frequency signal from an external source, each of said pair of elongated slots having an overall length 0.64 inches and a width 0.020 inches; and eight equally spaced apart vias, said eight vias being aligned adjacent one elongated edge of said antenna element, said eight vias allowing said antenna element to operate as a grounded ¼ wavelength radiating antenna by shorting said antenna element to a ground plane positioned below said dielectric substrate, each of said eight vias consisting of a copper plated through hole which electrically shorts said antenna element to said ground plane, said eight vias being spaced apart approximately 0.1045 inches from one another, each of said eight vias being located approximately 0.5 inches from said one elongated edge of said antenna element;

a copper transmission line connected to said antenna element, said copper transmission line being a signal input for said antenna element, said copper transmission line having a characteristic impedance of 100 ohms; and said pair of elongated slots providing for an isolation of approximately 50 decibels at a first center frequency of 1.575 GHz and a second center frequency of 2.25 GHz.

19. The microstrip antenna of claim 18 wherein a first elongated slot of said pair of elongated slots is positioned approximately 0.3558 inches from one end of said antenna element, and a second elongated slot of said pair of elongated slots is positioned approximately 0.3558 inches from the opposite end of said antenna element.

20. The micostrip antenna of claim 18 wherein said antenna element has a length of 1.15 inches and a width of 0.735 inches.

* * * * *